US010529216B1

(12) United States Patent
Thibault et al.

(10) Patent No.: US 10,529,216 B1
(45) Date of Patent: Jan. 7, 2020

(54) PERSONAL PROXIMITY SENSOR SYSTEMS

(71) Applicants: Rachel Thibault, Palmdale, CA (US); Michael Peters, Palmdale, CA (US); Nathan Campos, Lancaster, CA (US); Eric Corona, Lancaster, CA (US); Miles Driver, Lancaster, CA (US); Madelen Flores, Palmdale, CA (US); Cameron Franklin, Lancaster, CA (US); Janet Hawatmeh, Palmdale, CA (US); Laurice Hawatmeh, Palmdale, CA (US); Evelyn Machado, Palmdale, CA (US); Wesley Rather, Lancaster, CA (US); Catherine Thomas, Lancaster, CA (US); David Topchyan, Palmdale, CA (US)

(72) Inventors: Rachel Thibault, Palmdale, CA (US); Michael Peters, Palmdale, CA (US); Nathan Campos, Lancaster, CA (US); Eric Corona, Lancaster, CA (US); Miles Driver, Lancaster, CA (US); Madelen Flores, Palmdale, CA (US); Cameron Franklin, Lancaster, CA (US); Janet Hawatmeh, Palmdale, CA (US); Laurice Hawatmeh, Palmdale, CA (US); Evelyn Machado, Palmdale, CA (US); Wesley Rather, Lancaster, CA (US); Catherine Thomas, Lancaster, CA (US); David Topchyan, Palmdale, CA (US)

( * ) Notice: Subject to any disclaimer, the term of this patent is extended or adjusted under 35 U.S.C. 154(b) by 0 days.

(21) Appl. No.: 16/012,626

(22) Filed: Jun. 19, 2018

(51) Int. Cl.

| | |
|---|---|
| ***G08B 21/22*** | (2006.01) |
| ***G08B 21/02*** | (2006.01) |
| ***G08B 6/00*** | (2006.01) |

(52) U.S. Cl.
CPC ..... *G08B 21/22* (2013.01); *G08B 6/00* (2013.01); *G08B 21/02* (2013.01)

(58) Field of Classification Search
CPC ..... G08B 21/18; G08B 21/24; G08B 21/182; G08B 21/22; G08B 13/1427; G08B 21/02; G08B 25/10; G08B 21/0247; G08B 21/0277; G08B 3/10
USPC ..... 340/686.6
See application file for complete search history.

(56) References Cited

U.S. PATENT DOCUMENTS

| | | | | |
|---|---|---|---|---|
| 6,441,623 | B1 | 8/2002 | Moon | |
| 2010/0194209 | A1 | 8/2010 | Richter | |
| 2016/0098138 | A1* | 4/2016 | Park | G06F 3/0416 345/173 |
| 2016/0328021 | A1* | 11/2016 | Lee | G06F 3/011 |
| 2018/0013947 | A1* | 1/2018 | Kim | G06F 13/14 |
| 2018/0027894 | A1* | 2/2018 | Bangera | A41D 13/018 |
| 2018/0036531 | A1* | 2/2018 | Schwarz | G06F 3/015 |
| 2018/0079359 | A1* | 3/2018 | Park | B60W 30/08 |
| 2018/0174450 | A1* | 6/2018 | Im | B60K 35/00 |
| 2018/0174597 | A1* | 6/2018 | Lee | H04R 29/005 |

(Continued)

*Primary Examiner* — Mark S Blouin
(74) *Attorney, Agent, or Firm* — Adam R. Stephenson, Ltd.

(57) ABSTRACT

Implementations of a sensing device may include: a circuit board including a microprocessor, an ultrasonic sensor coupled with the circuit board, an infrared sensor coupled with the circuit board, and a wireless communication module coupled with the circuit board. Each of the ultrasonic sensor and the infrared sensor may be configured to receive input from the surroundings of the user to indicate a presence of an individual behind the user.

17 Claims, 3 Drawing Sheets

(56) References Cited

U.S. PATENT DOCUMENTS

| | | | | |
|---|---|---|---|---|
| 2018/0220972 | A1* | 8/2018 | Jeong | A61B 5/681 |
| 2019/0023395 | A1* | 1/2019 | Lee | B64C 39/024 |
| 2019/0094849 | A1* | 3/2019 | Kim | H04W 4/029 |

* cited by examiner

PERSONAL PROXIMITY SENSOR SYSTEMS

BACKGROUND

1. Technical Field

Aspects of this document relate generally to personal protection devices such as sensors to detect large bodies.

2. Background

People are advised to not walk alone at night. Security guards are available to walk employees to their vehicles late at night. On many college campuses, college students may call campus public safety for an escort from the library/lab to their car and/or dorm room for increased protection and security.

SUMMARY

Implementations of a sensing device may include: a circuit board including a microprocessor, an ultrasonic sensor coupled with the circuit board, an infrared sensor coupled with the circuit board, and a wireless communication module coupled with the circuit board. Each of the ultrasonic sensor and the infrared sensor may be configured to receive input from the surroundings of the user to indicate a presence of an individual behind the user.

Implementations of sensing devices may include one, all, or any of the following:

The wireless communication module may send a signal across a telecommunication channel to a mobile computing device associated with the user to alert the user of the presence of an individual behind the user.

The sensing device may further include a case around the circuit board, the microprocessor, the ultrasonic sensor, the infrared sensor, and the wireless communication module.

The device may further include a haptic feedback mechanism coupled with the circuit board.

The ultrasonic sensor and the infrared sensor may be configured to detect an individual within 20 feet of the user.

The device may be included within a bracelet.

The device may also include a battery pack, a micro universal serial bus (USB), and a USB charger all operatively coupled with the circuit board.

Implementations of a system for detecting a presence of a person may include: a sensing device. The sensing device may include a circuit board including a microprocessor. The sensing device may also include an ultrasonic sensor, an infrared sensor, and a wireless communication module physically coupled with the circuit board and electronically coupled with the microprocessor. The system may include an outer case around the sensing device. The sensing device may be configured to detect the presence of an individual behind a user. In response to detecting the presence of the individual the sensing device may send a signal over a telecommunication channel to a mobile computing device associated with a phone of the user through the wireless communication module.

Implementations of a system for detecting a presence of a person may include one, all, or any of the following:

The system may further include a clip coupled to an outer surface of the outer casing.

The sensing device may be configured to be coupled to the user's back.

The system may further include a haptic feedback mechanism coupled with the circuit board.

The ultrasonic sensor and the infrared sensor are configured to detect an individual within 20 feet of the user.

The sensing device may be included within a bracelet.

The system may further include a battery pack, a micro universal serial bus (USB), and a USB charger physically operatively coupled with the circuit board and electronically coupled with the microprocessor.

Implementations of a method may be used for detecting an individual behind a user, the method may include: coupling a sensing device to an article of clothing of a user. The sensing device may include a circuit board having a microprocessor. The sensing device may also include an ultrasonic sensor, an infrared sensor, and a wireless communication module physically coupled with the circuit board and electronically coupled with the microprocessor. The sensing device may be include an outer casing around the sensing device. The method may also include detecting an individual behind a user through each of the ultrasonic sensor and the infrared sensor. The method may also include sending a signal over a telecommunication channel to a mobile computing device associated with a phone of the user through the wireless communication module. The method may also include indicating a presence of the individual behind the user on an interface of the mobile computing device.

Implementations of a method for detecting an individual behind a user may include one, all, or any of the following:

The method may further include haptically indicating the presence of an individual behind the user through a haptic feedback mechanism comprised within the sensing device.

The method may further include charging a battery pack of the sensing device through a micro universal serial bus (USB) and a USB charger.

A clip may be coupled to the outer casing around the sensing device.

The sensing device may be included within a bracelet.

The individual detected behind the user may be within 20 feet of the user.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended personal proximity sensor systems will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such personal proximity sensor systems, and implementing components and methods, consistent with the intended operation and methods.

Figure 1:
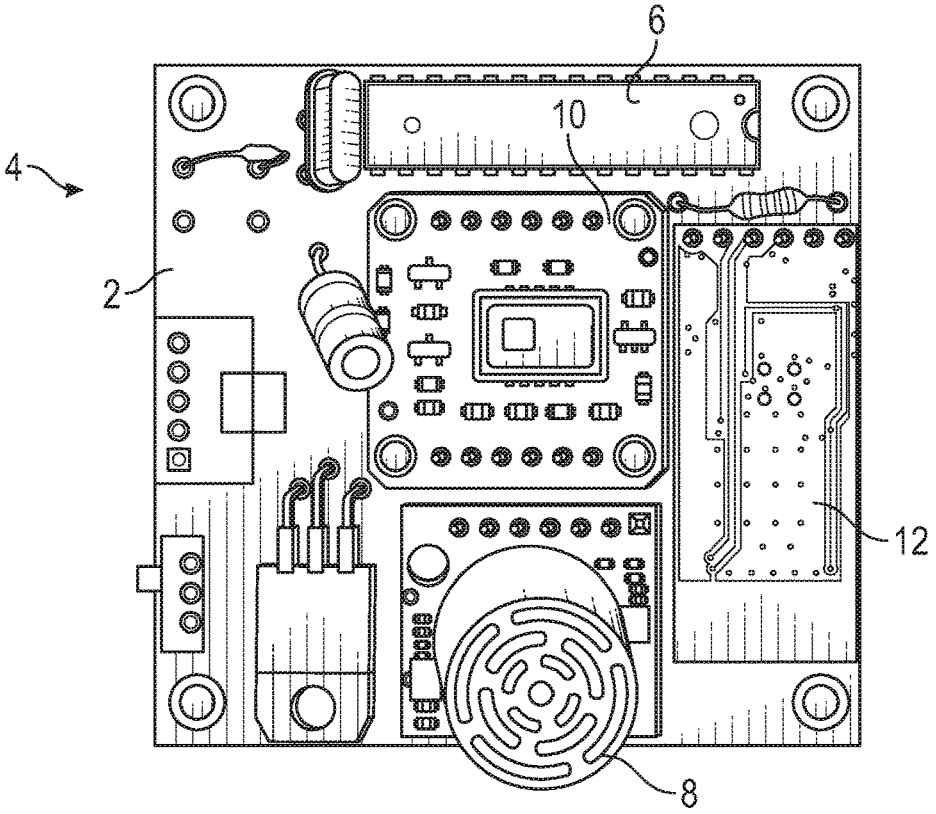
FIG. 1 is a top view of an implementation of a sensing system circuit board having components attached thereto.

Referring to FIG. 1, an implementation of a circuit board 2 of a sensing device 4 is illustrated. The sensing device 4 includes a microprocessor 6 coupled to the circuit board 2. The microprocessor 6 is electrically coupled with/in communication with an ultrasonic sensor 8, an infrared sensor 10, and a Bluetooth board 12 (wireless communication module). The ultrasonic sensor 8, the infrared sensor 10, and the Bluetooth board 12 are each individually coupled with the circuit board 2 as well. During use of the sensing device 4, the ultrasonic sensor 8 and the infrared sensor 10 each receive input from the surroundings of a user to detect an individual located behind the user. The infrared sensor 10 works to detect the infrared light or "heat signature" of a person within range of the sensor and provides corresponding electrical signal feedback to the microprocessor 6. The ultrasonic sensor 8 is able to detect sounds made by a person located behind the user and provide corresponding electrical signal feedback to the microprocessor 6. In this way, the sensing device 4 may be used to give a user "eyes behind his/her head" to detect a danger behind the user such as an individual trying to harm the user. For example, the sensing device may be used by people walking alone at night such as college students leaving the library or other study locations like coffee shops, restaurants, etc. at night. Nurses and other medical professionals working long shifts that end late at night or in early morning hours when it is dark and not a lot of people are around may also have a use for implementations of the sensing device 4. The sensing device provides protection for users in these situations in the ability to monitor the area behind them.

Referring again to FIG. 1, various implementations of the microprocessor 6 may come preassembled to the circuit board 2 or separate from the board 2. In various implementations, the microprocessor may be included in an Arduino Uno 3 (Atmega328) manufactured by Arduino, LLC of Somerville, Mass. and be a microprocessor manufactured under the tradename ATMEGA328 by Atmel Corporation of San Jose, Calif. In other implementations, however, the microprocessor may be individually attached to the circuit board and not included in an Arduino unit. The microprocessor 6 receives signals from the ultrasonic sensor 8 and infrared sensor 10 and uses those signals to determine whether or not a living body of a substantial size is moving/present in the surroundings of the user within the view of the sensors. In various implementations, the sensing device, either through adjusting the sensitivity of the sensors or through logical analysis of the sensor output using, by non-limiting example, threshold output values, accumulation of signal over predetermined periods of item, averaging, or any other signal processing technique, will be tuned to not alert the user to the presence of small animals such as rabbits, cats, or dogs that may be present in the surroundings of the user. In various implementations, the user may be notified of the presence of an individual through a mobile computing device. Communicating with the microprocessor of the device, the Bluetooth board 12 of the may send a signal across a telecommunication channel to a mobile computing device associated with the user. This particular implementation of a Bluetooth board that may be used in various implementations may be an HC-05 Bluetooth Serial Pass manufactured by DSD TECH of China. While the use of Bluetooth boards/modules is disclosed herein, other wireless transceiver/transmitter devices (wireless communications modules) may be employed in various implementations, including, by non-limiting example, near field communication devices, Wi-Fi communication devices, Zigbee communication devices, any other wireless telecommunication device system and/or protocol type.

Referring to FIG. 1, the ultrasonic sensor may be used to detect an object within a predetermined range by sending out a high-frequency sound pulse and timing how long it takes for the echo of the sound to reflect back to the receptor of the sensor. In various implementations, the ultrasonic sensor may detect movement as well as size of a body and/or individual in the surroundings of the user. As illustrated in FIG. 1, the ultrasonic sensor 8 has multiple openings, some of the openings transmit ultrasonic waves like a speaker and the other openings receive the ultrasonic waves that bounce back from hitting an object, like a microphone. In this particular implementation, the ultrasonic sensor 8 that may be used may be one marketed under the name Ultrasonic Rangefinder—LV-EV1 manufactured by Maxbotix, INC. of Branierd, Minn.

Referring again to FIG. 1, the infrared sensor 10 is used to sense heat in an area surrounding the user. In various implementations, an infrared sensor 10 may be used to detect objects, heat, and motion by either emitting and/or detecting infrared radiation. In other implementations of a heat sensing device, other forms of temperature sensors may be used to sense heat coming from the body of an individual in the surroundings of a user. This particular implementation of an infrared sensor marketed as a AMG8833 IR Thermal camera manufactured by Adafruit of New York City, N.Y. This particular heat sensor can detect temperatures ranging from 0° C. to 80° C. (32° F. to 176° F.) with an accuracy of +/−2.5° C. (4.5° F.). This particular sensor can be used to detect the heat signature of a human from a distance of up to 7 meters (23 feet) from the sensor.

Figure 2:
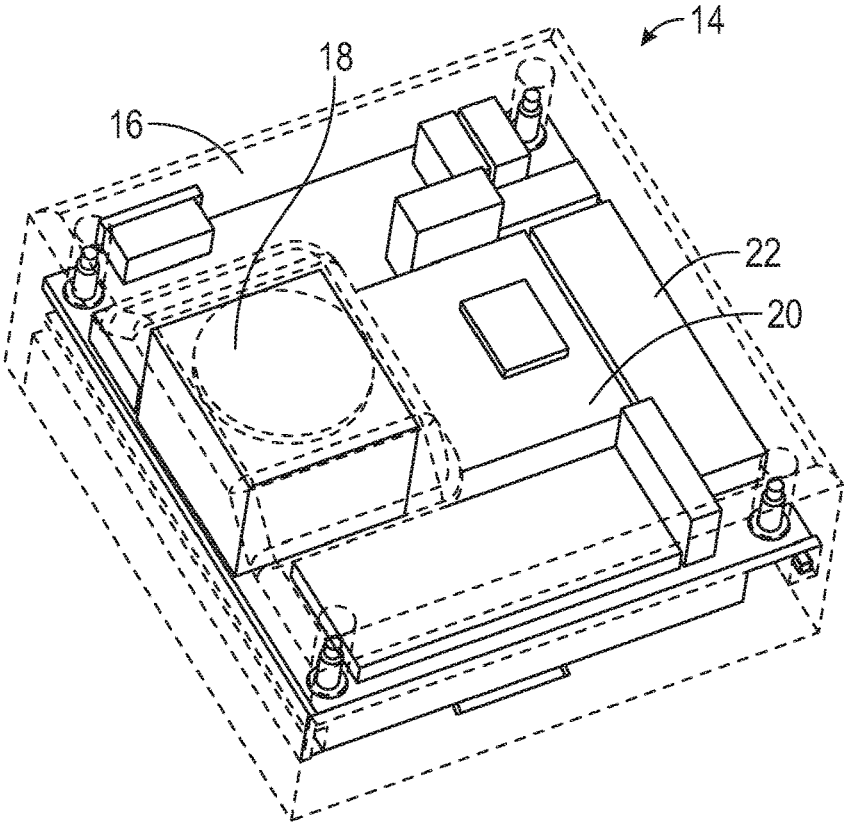
FIG. 2 is a see through perspective view of an implementation of a sensing device.
Figure 3:
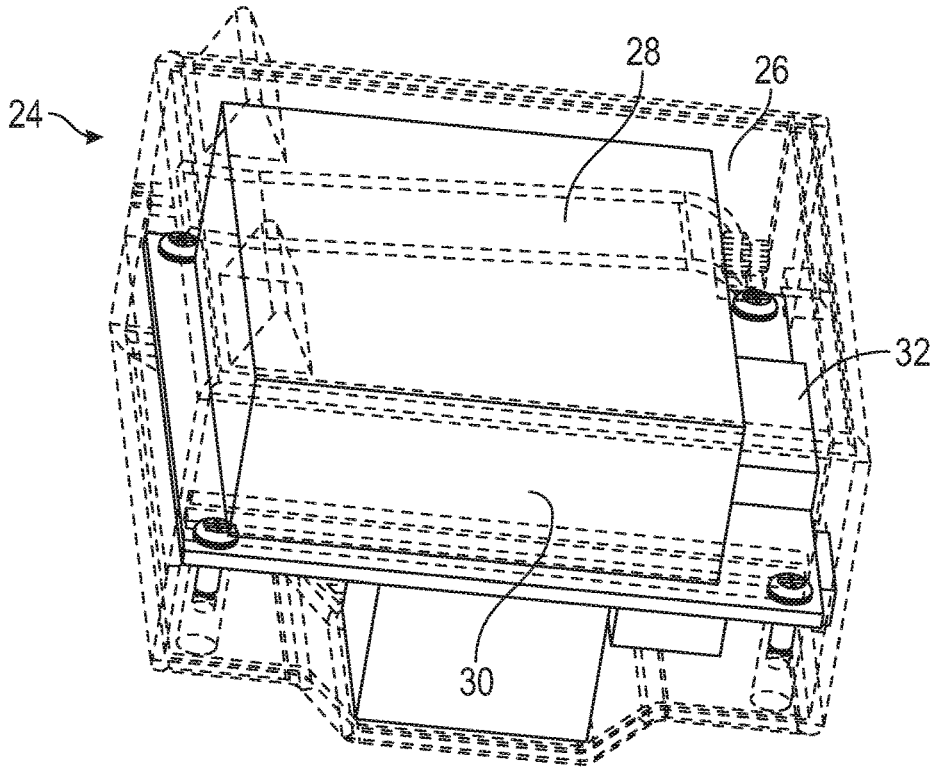
FIG. 3 is a see through side view of an implementation of a sensing device.

Referring to FIG. 2, a see through interior view of a sensing device 14 is illustrated. As illustrated, a case 16 encloses the circuit board and connected sensors such as the ultrasonic sensor 18, the infrared sensor 20 and Bluetooth board 22. In various implementations, there may be openings in the case to enable the sensors of the device to interact with/view the surroundings of the user. In some implementations, a clip 28 may be coupled to the outside of the case 26 as illustrated in FIG. 3. The clip may allow a user to couple the sensing device to clothing including a shirt or jacket. By non-limiting example, the clip may also couple the sensing device to a hat, bag, backpack, or other object on the body of the user. In some implementations of a sensing device 24, the device may be included in a bracelet allowing the user to wear the sensing device on an arm. In addition to the sensing device sending an alert to a mobile computing device of a user, the user may also be notified of an individual within 20 feet of the user through a haptic feedback mechanism. A haptic feedback mechanism is the use of the sense of touch in a user interface to provide information to an end user. In implementations of a sensing device, the haptic feedback mechanism may be included within the case of the sensing device and may cause the entire device or a portion of the device to vibrate when an individual is sensed behind the user. In some implementations, the haptic feedback mechanism may be coupled to the circuit board of an implementation of a sensing device. In other implementations, the haptic feedback mechanism may be wirelessly coupled with the device and may be included on another area of the user's person such as in a bracelet, smartwatch, or in a bag the user may be carrying. In still other implementations, the haptic feedback mechanism may communicate with the user through a mobile computing device wirelessly coupled with the device causing the mobile computing device to vibrate or make another similar movement to indicate the presence of an individual behind the user.

Figure 4:
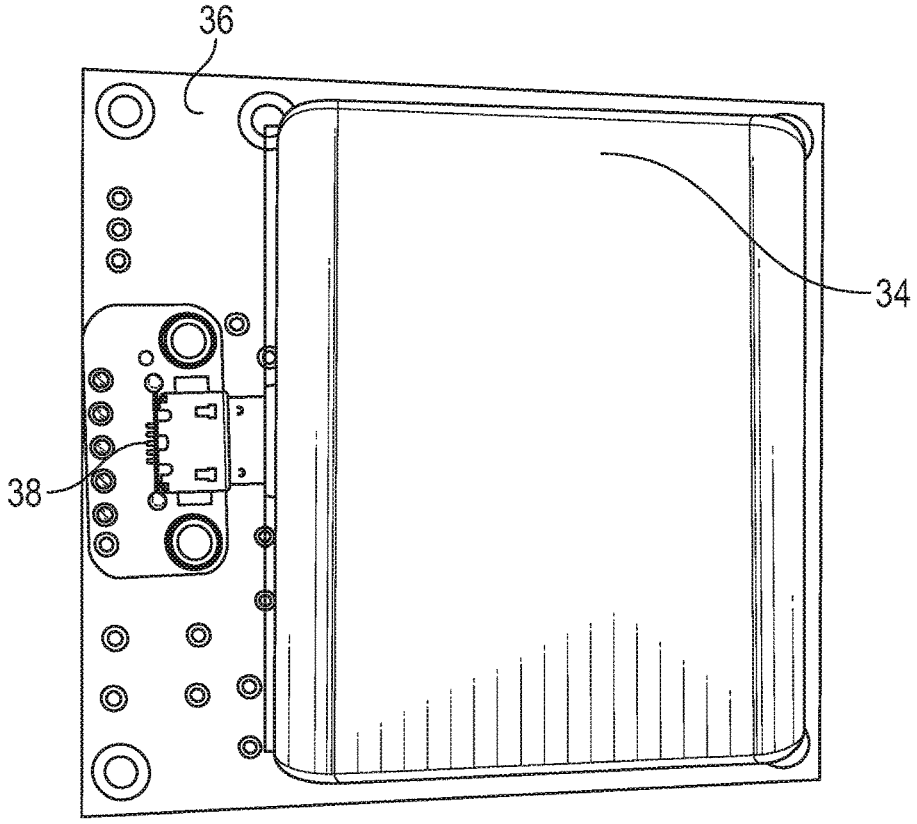
FIG. 4 is a top view of an implementation of a battery pack.

Referring to FIG. 3, a side view of an implementation of a sensing device 24 is illustrated. In this view, the case 26 having a clip 28 coupled thereto as previously described is illustrated. In this view a battery pack 30 is also visible. The battery pack 34 is coupled to a second side of the circuit board 36 as illustrated in FIG. 4. In various implementations, the battery pack 30/34 is electrically coupled with a micro universal serial bus (USB), and a USB charger 32/38 (though other charging systems/protocols, including wireless charging systems may be used in various implementations). In various implementations, the battery pack and associated charger may be used to charge the components of sensing device.

Figure 5:
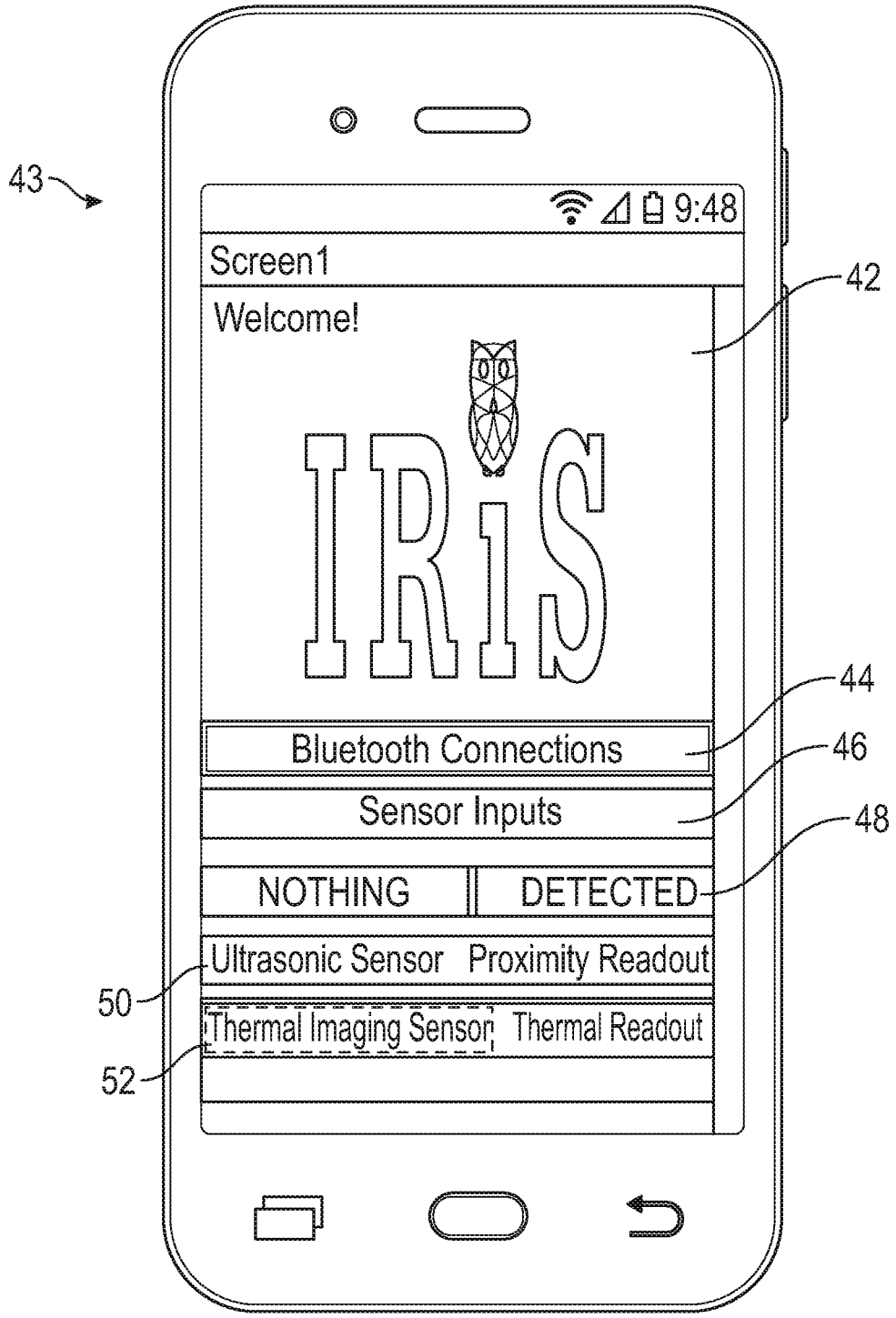
FIG. 5 is a schematic of an implementation of an interface on a mobile computing device.

Referring to FIG. 5, an implementation of an interface 42 of a mobile computing device is illustrated. The interface 42 is an example of the application that may be used to operate and communicate with the sensing device. In various examples, the interface may include buttons to monitor "Bluetooth Connections" 44 through the Bluetooth board of the sensing device, allowing proper pairing of the Bluetooth module(s) and device(s). The interface 42 may also include a banner 46 labeled "Sensor Inputs" under which a menu of the various sensors is listed. One heading 48 indicates visually on the interface whether an individual has been detected in an area surrounding a user. Another heading 50 indicates the status of the ultrasonic sensor. In various implementations the sensor for the Thermal Imaging Sensor 52 may include a button enabling a user to view a picture formed from data collected by the infrared sensor/camera. In other implementations, the headings and buttons on the interface of the mobile computing device may be arranged differently and may include other features, including, by non-limiting example, sensor readings, sensor status outputs, warning messages, date and time information, time of detection information, and any other desired system parameter.

Implementations of a method for detecting an individual behind a user may include coupling a sensing device 14 to an article of clothing of a user. As previously described, the sensing device may include a circuit board 2 having a microprocessor 6 coupled thereto and an ultrasonic sensor 8, an infrared sensor 10, and a Bluetooth serial board 12 (wireless communication module) physically coupled with the circuit board 2. The sensors may also be electronically coupled with the microprocessor 6. The sensing device may include an outer casing 16. The method may include detecting an individual behind a user through each of the ultrasonic sensor and the infrared sensor. The method may also include sending a signal corresponding with the detection including information about the individual over a telecommunication channel to a mobile computing device associated with user. The mobile computing device may be associated with the sensing device through software coding/wireless pairing. The signal may be sent to the mobile computing device through the Bluetooth serial board. The method may include indicating a presence of the individual behind the user on an interface of the mobile computing device. In various implementations, the mobile computing device may indicate the presence of an individual through, by non-limiting example, a haptic feedback mechanism, through a sound indicator, or other systems and methods of alerting the user to the presence of an individual without also alerting the individual.

In places where the description above refers to particular implementations of personal sensing device and implementing components, sub-components, methods and sub-methods, it should be readily apparent that a number of modifications may be made without departing from the spirit thereof and that these implementations, implementing components, sub-components, methods and sub-methods may be applied to other personal sensing devices.

What is claimed is:

1. A sensing device comprising:

a circuit board comprising a microprocessor, the circuit board configured to be coupled to one of a garment or an object on a body of a user;

an ultrasonic sensor coupled with the circuit board;

an infrared sensor coupled with the circuit board; and a wireless communication module coupled with the circuit board;

wherein each of the ultrasonic sensor and the infrared sensor are configured to receive input from the surroundings of the user to indicate a presence of an individual other than the user located behind the user.

2. The device of claim 1, wherein the wireless communication module sends a signal across a telecommunication channel to a mobile computing device associated with the user to alert the user of the presence of the individual behind the user.

3. The device of claim 1, further comprising a case comprised around the circuit board, the microprocessor, the ultrasonic sensor, the infrared sensor, and the wireless communication module.

4. The device of claim 1, further comprising a haptic feedback mechanism coupled with the circuit board.

5. The device of claim 1, wherein the ultrasonic sensor and the infrared sensor are configured to detect the individual within 20 feet of the user.

6. The device of claim 1, further comprising a battery pack, a micro universal serial bus (USB), and a USB charger all operatively coupled with the circuit board.

7. A system for detecting a presence of a person comprising:

a sensing device comprising:

a circuit board comprising a microprocessor;

an ultrasonic sensor, an infrared sensor, and a wireless communication module physically coupled with the circuit board and electronically coupled with the microprocessor; and an outer casing comprised around the sensing device, the outer casing configured to be coupled to one of a garment or an object on a body of a user;

wherein the sensing device is configured to detect the presence of an individual other than the user behind the user and, in response to detecting, send a signal over a telecommunication channel using the wireless communication module to a mobile computing device associated with the user.

8. The system of claim 7, further comprising a clip coupled to an outer surface of the outer casing.

9. The system of claim 7, wherein the sensing device is configured to be coupled to the user's back.

10. The device of claim 7, further comprising a haptic feedback mechanism coupled with the circuit board.

11. The device of claim 7, wherein the ultrasonic sensor and the infrared sensor are configured to configured to detect the individual within 20 feet of the user.

12. The device of claim 7, further comprising a battery pack, a micro universal serial bus (USB), and a USB charger physically operatively coupled with the circuit board and electronically coupled with the microprocessor.

13. A method for detecting an individual behind a user, the method comprising:

coupling a sensing device to one of a garment or an object on a body of a user, the sensing device comprising:

a circuit board comprising a microprocessor;

an ultrasonic sensor, an infrared sensor, and a wireless communication module physically coupled with the circuit board and electronically coupled with the microprocessor; and an outer casing comprised around the sensing device;

detecting an individual other than the user behind a user through each of the ultrasonic sensor and the infrared sensor;

sending a signal over a telecommunication channel to a mobile computing device of the user through the wireless communication module; and indicating a presence of the individual behind the user on an interface of the mobile computing device.

14. The method of claim 13, further comprising haptically indicating the presence of an individual behind the user through a haptic feedback mechanism comprised within the sensing device.

15. The method of claim 13, further comprising charging a battery pack of the sensing device through a micro universal serial bus (USB) and a USB charger.

16. The method of claim 13, wherein a clip is coupled to the outer casing comprised around the sensing device.

17. The method of claim 13, wherein the individual behind the user is within 20 feet of the user.

* * * * *